US010946510B1

(12) United States Patent
Stratiou et al.

(10) Patent No.: US 10,946,510 B1
(45) Date of Patent: Mar. 16, 2021

(54) CAULK CADDY AND CORRESPONDING METHOD AND SYSTEM

(71) Applicant: John Stratiou, Henrico, VA (US)

(72) Inventors: John Stratiou, Henrico, VA (US); Christopher Murray, Richmond, VA (US)

(73) Assignee: John Stratiou, Henrico, VA (US)

( * ) Notice: Subject to any disclaimer, the term of this patent is extended or adjusted under 35 U.S.C. 154(b) by 52 days.

(21) Appl. No.: 16/557,264

(22) Filed: Aug. 30, 2019

(51) Int. Cl.
*B25H 3/00* (2006.01)
*B65D 85/62* (2006.01)

(52) U.S. Cl.
CPC ..... *B25H 3/00* (2013.01); *B65D 85/62* (2013.01)

(58) Field of Classification Search
CPC . B25H 3/00; B25H 3/02; B25H 3/026; B25H 3/06; B65D 85/00; B65D 85/14; B65D 85/62; B65D 85/28
USPC ..... 206/277, 372, 373; 211/70.6; 220/23.87, 220/23.89
See application file for complete search history.

(56) References Cited

U.S. PATENT DOCUMENTS

| | | | | |
|---|---|---|---|---|
| 5,092,463 | A | 3/1992 | Dees | |
| D382,998 | S | 9/1997 | Conigliaro | |
| 5,836,446 | A * | 11/1998 | Varnom | B25H 3/026 206/373 |
| 7,159,735 | B2 | 1/2007 | Morse | |
| 8,469,188 | B1 | 6/2013 | Vitale | |
| D685,971 | S | 7/2013 | Thibault | |
| 9,956,684 | B2 | 5/2018 | Welfel et al. | |
| 2011/0180437 | A1 | 7/2011 | Alt | |
| 2018/0214906 | A1 * | 8/2018 | Gonzalez | B25H 3/06 |

* cited by examiner

*Primary Examiner* — Bryon P Gehman
(74) *Attorney, Agent, or Firm* — Patent Law of Virginia, PLLC; Brian J. Teague

(57) ABSTRACT

A device for receiving and holding a plurality of objects comprises a main body having a plurality of chambers defined therein and a plurality of resilient tabs attached to or integral with the main body and spaced about a perimeter of the main body. Each chamber has an open top end and is adapted to receive at least one object via its open top end. Each tab is adapted to support the device on a top rim of a bucket such that the main body is elevated off a floor of the bucket. Each tab is adapted to flex inward toward a longitudinal axis of the main body when a downward force is applied to the main body such that the main body and the tabs move downward into the bucket until the main body contacts the floor of the bucket.

25 Claims, 8 Drawing Sheets

CAULK CADDY AND CORRESPONDING METHOD AND SYSTEM

FIELD OF THE INVENTION

The present invention relates to devices and methods for receiving, holding, and carrying elongated tubes of materials, such as caulk.

BACKGROUND

Painters, carpenters, and the like have many tools and products that they use frequently in their work. As such, having an organized system for storing, carrying, and accessing such tools and products is important. One such product type that is frequently used includes caulks, adhesives, sealants, and the like which are typically supplied in elongated cylindrical tubes. Painters, carpenters, and the like use a great deal of these types of products, and typically many different versions. It can be a challenge to store, carry, and access these tubes of material in an organized manner that will enable a user to readily identify and access the specific desired product.

BRIEF SUMMARY OF THE DISCLOSURE

A device for receiving and holding a plurality of objects comprises a main body having a plurality of chambers defined therein and a plurality of resilient tabs attached to or integral with the main body and spaced about a perimeter of the main body. Each chamber has an open top end and is adapted to receive at least one object via its open top end. Each tab is adapted to support the device on a top rim of a bucket such that the main body is elevated off a floor of the bucket. Each tab is adapted to flex inward when a downward force is applied to the main body such that the main body and the tabs move downward into the bucket until the main body contacts the floor of the bucket.

The device may further comprise a handle projecting upward from the main body.

The chambers may be substantially vertical. The chambers may be substantially cylindrical. At least one hole may be defined in a side wall or a floor of each chamber.

The plurality of tabs may comprise three tabs. The tabs may be evenly spaced about the perimeter of the main body.

Each tab may comprise a first section that projects downward and outward from the main body, a second section that projects upward and outward from the first section, and a third section that projects outward from the second section. The third section of each tab may be adapted to sit on the top rim of the bucket to support the main body.

In alternative embodiments of the invention, a method of storing and carrying a plurality of objects comprises inserting each of the plurality of objects into a corresponding chamber of a device having a main body in which the plurality of chambers are defined and a plurality of resilient tabs attached to or integral with the main body and spaced about a perimeter of the main body, wherein each chamber has an open top end, wherein each tab is adapted to support the device on a top rim of a bucket such that the main body is elevated off a floor of the bucket, wherein each tab is adapted to flex inward when a downward force is applied to the main body such that the main body and the tabs move downward into the bucket until the main body contacts the floor of the bucket; placing the device into the bucket such that the device is supported on the top rim of the bucket and such that the main body is elevated off a floor of the bucket; and applying a downward force to the main body such that the main body and the tabs move downward into the bucket until the main body contacts the floor of the bucket.

The method may further comprise applying an upward force to the main body such that the main body and the tabs move upward until the tabs are above the top rim of the bucket and spring outward such that the device is supported on the top rim of the bucket and such that the main body is elevated off a floor of the bucket.

In alternative embodiments of the invention, a system for receiving and holding a plurality of objects comprises the device as described above and a bucket having a top rim, a floor, and a wall therebetween.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
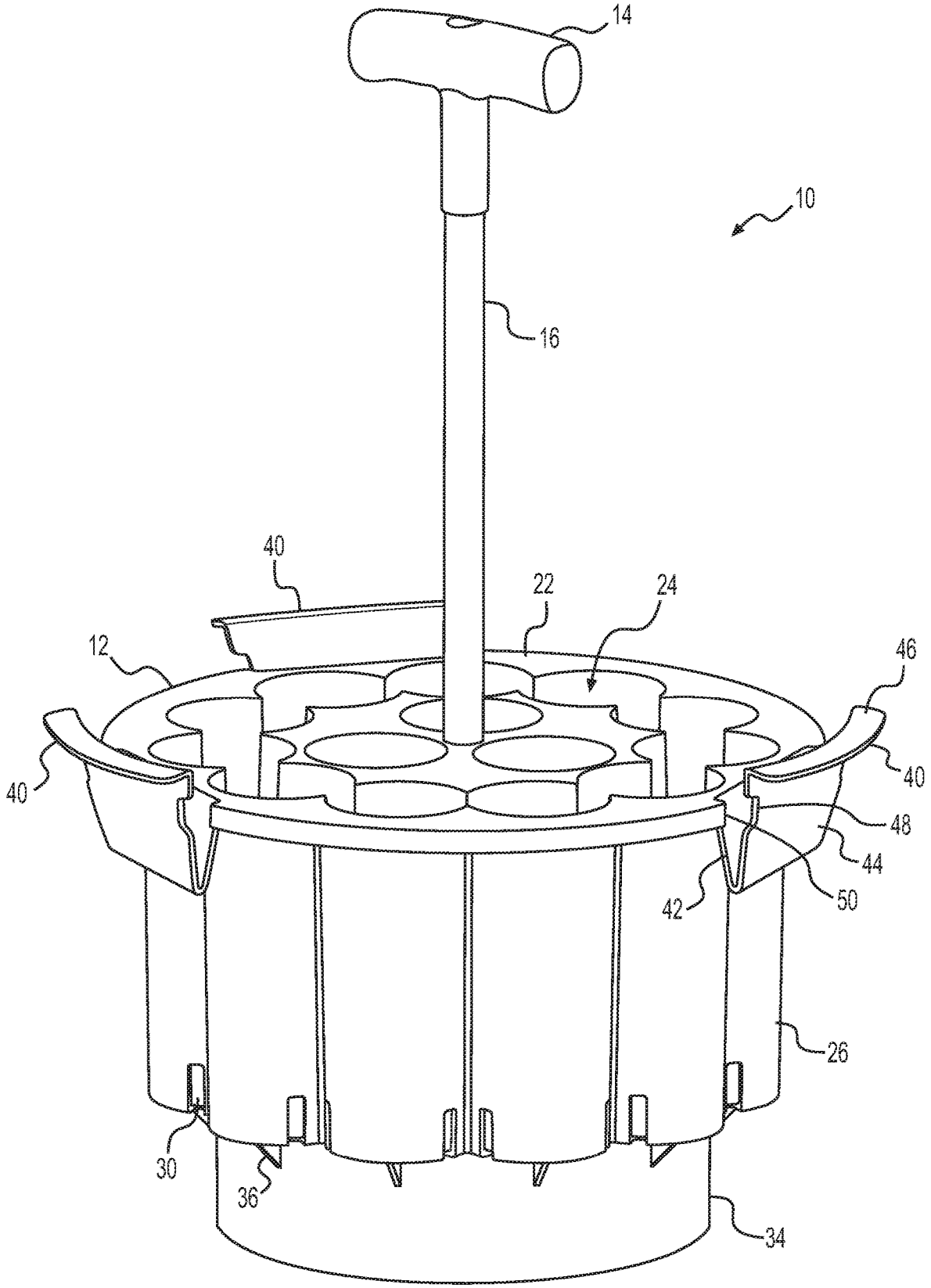
FIG. 1 is a perspective view of a caulk caddy, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention comprise a device, method, and system for storing and carrying any suitable objects, but especially elongated dispensing tubes of caulks, adhesives, sealants, and the like (referred to herein generically as caulk).

Figure 2:
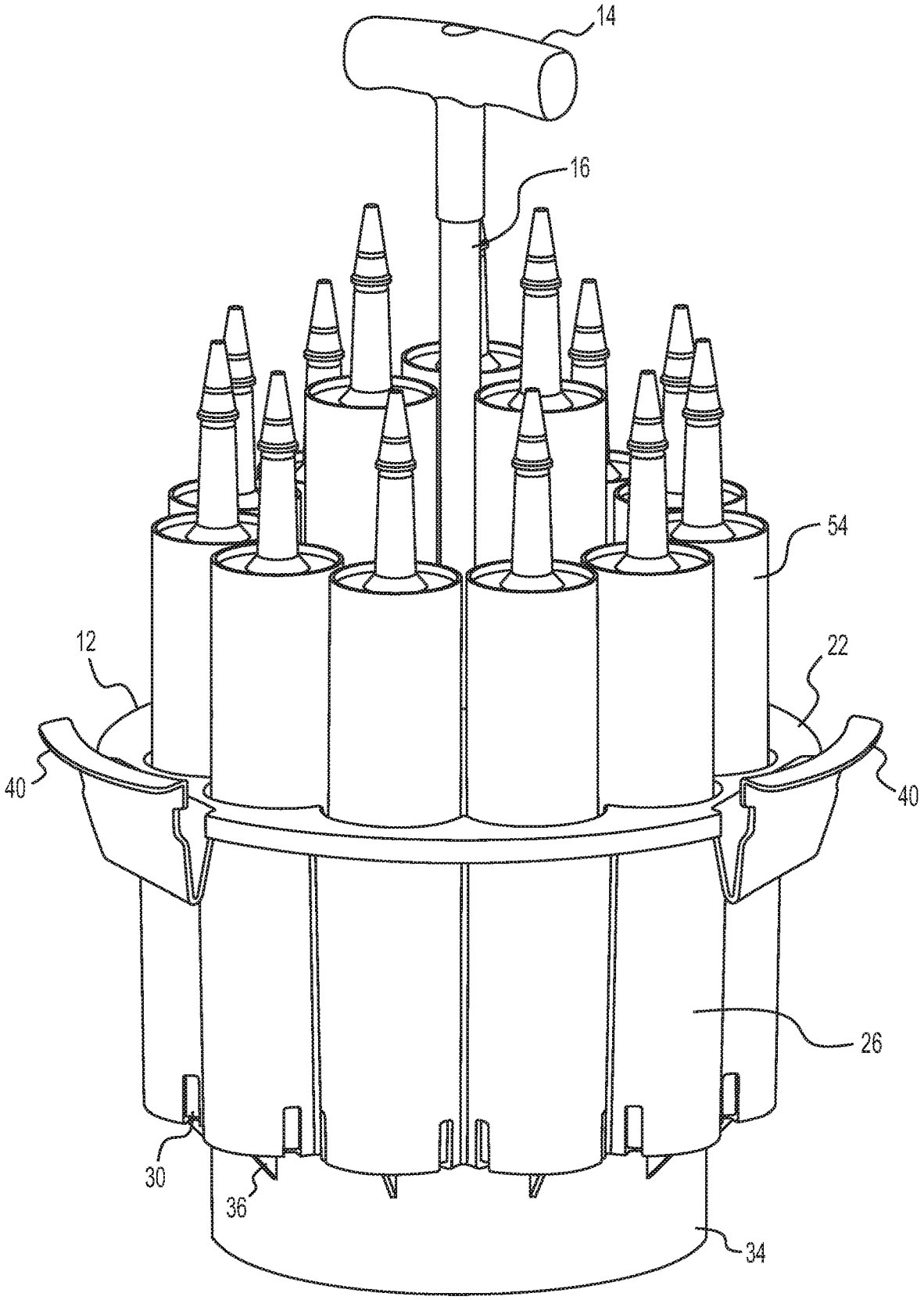
FIG. 2 is a perspective view of the caulk caddy of FIG. 1 into which tubes of caulk have been inserted.
Figure 3:
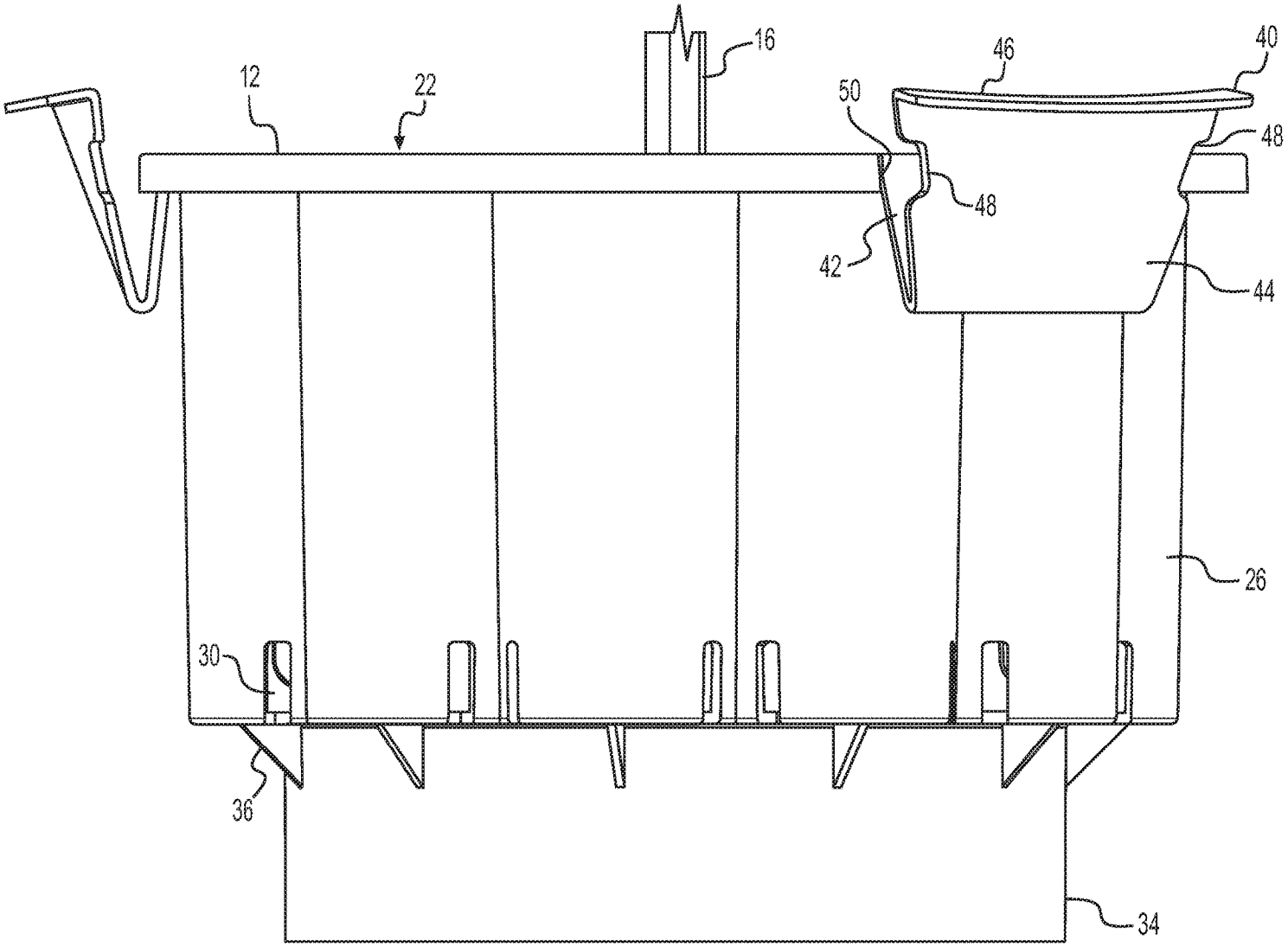
FIG. 3 is a side view of the caulk caddy of FIG. 1.
Figure 4:
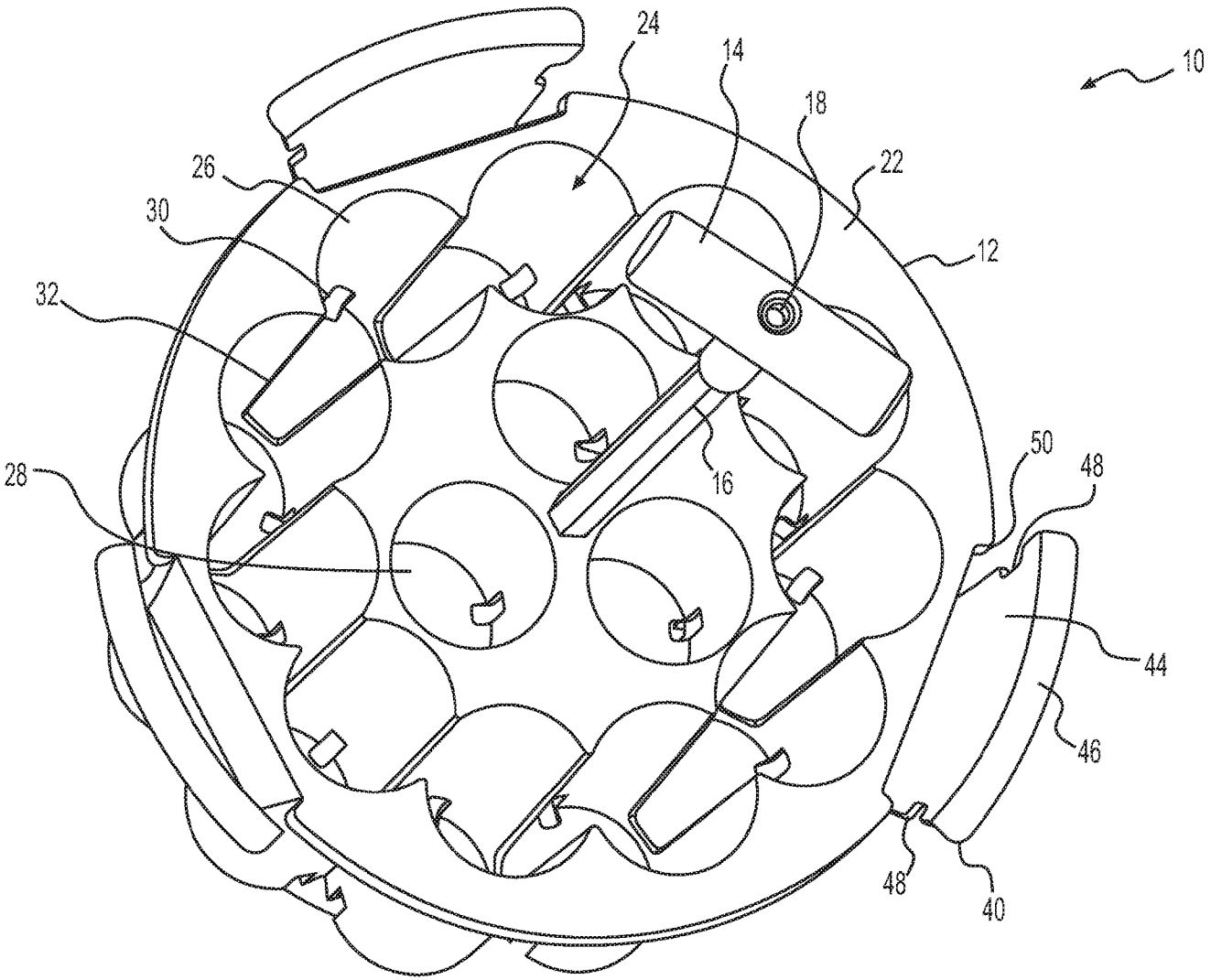
FIG. 4 is a top perspective view of the caulk caddy of FIG. 1.

Referring now to the figures, a device 10 for receiving, holding, and carrying a plurality of objects, such as elongated tubes 54 of caulks, adhesives, sealants, and the like is illustrated in accordance with one embodiment of the invention. The device 10 will be referred to herein as a "caulk caddy" or simply a "caddy," although the device is not limited to use with tubes of caulk but rather may be used to carry any suitable objects. The caddy 10 comprises a main body 12 having a plurality of chambers 24 defined therein. The main body may be constructed of any suitable material, such as any suitably strong and durable plastic. In one specific embodiment of the invention, the main body 12 is constructed of polypropylene (possibly with talc as a reinforcing filler. The chambers 24 will typically (but not necessarily) be substantially vertical and substantially cylindrical (in this context, substantially means that some variation from vertical and/or cylindrical is tolerable as long as the functionality is not adversely affected), with each chamber 24 having a rounded wall 26, a floor 28, and an open top end. The open top ends of the chambers 24 are defined in the top deck 22 of the main body 12. In the illustrated embodiment, there are two concentric rings of chambers, with three chambers in the inner ring and eleven chambers in the outer ring. In the illustrated embodiment, the floors of the inner ring chambers are higher than the floors of the outer ring chambers. In this regard, tubes of caulk stored in the inner ring chambers will sit higher than tubes stored in the outer rings chambers, as illustrated in FIG. 2. This tiered arrangement is advantageous as it makes it easier for a user to see the body of the tubes in the inner ring chambers to identify the specific product. Any suitable size, shape, number, and arrangement of chambers may be used.

There may be openings 32 between the chambers (as in the illustrated outer ring chambers) or the chamber walls may be complete with no such gaps (as in the illustrated inner ring chambers). These openings assist with drainage and reduce the overall weight of the product. One or more drainage holes 30 may be defined in the walls 26 and/or floor 28 of some or all of the chambers 24. In the illustrated embodiment, three drainage holes 30 are defined in each of the chambers 24, with each drainage hole 30 being partly defined in the wall 26 and partly defined in the floor 28 of each chamber 24. Any suitable number or arrangement of drainage holes may be used.

Figure 5:
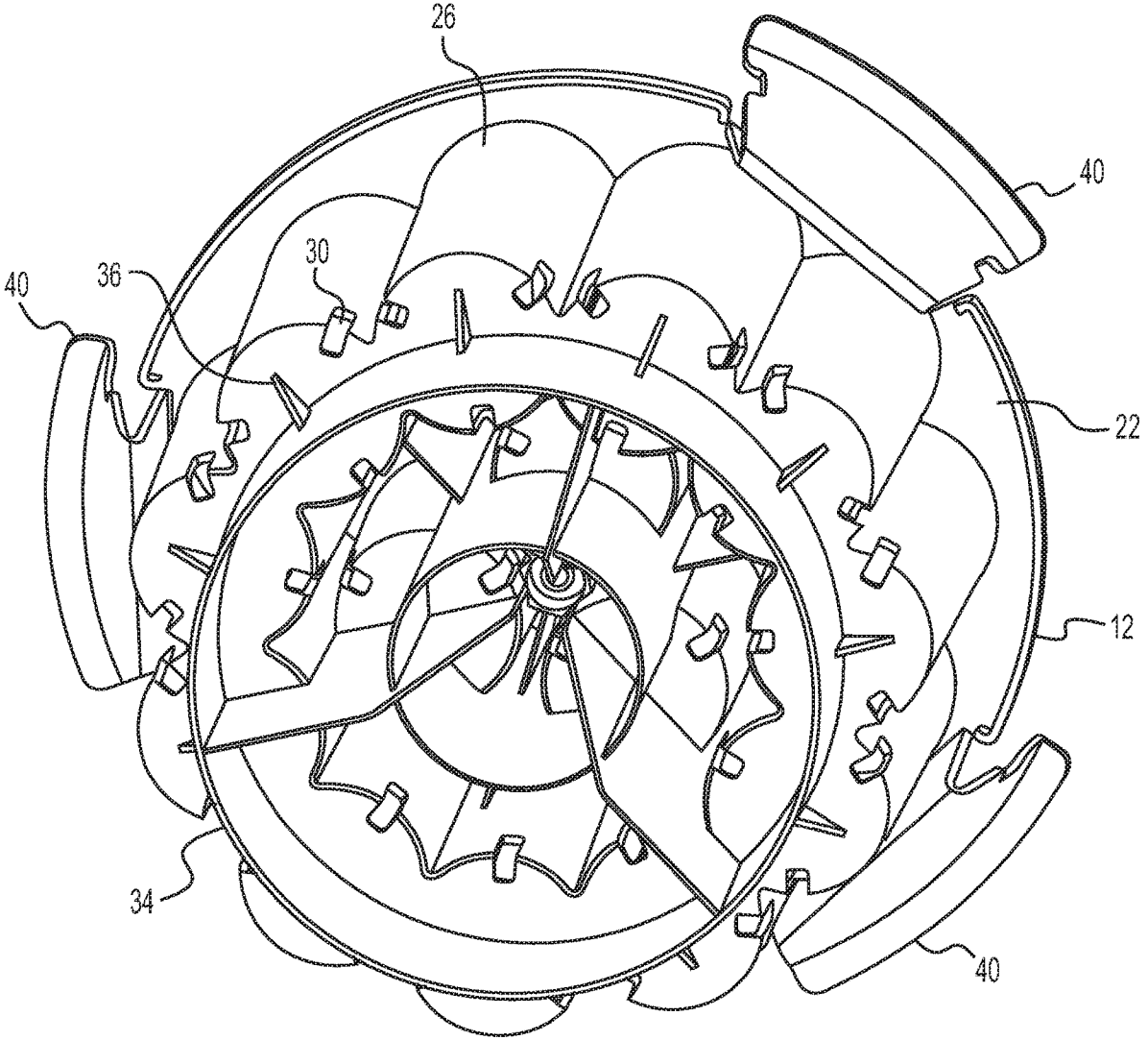
FIG. 5 is a bottom perspective view of the caulk caddy of FIG. 1.
Figure 6:
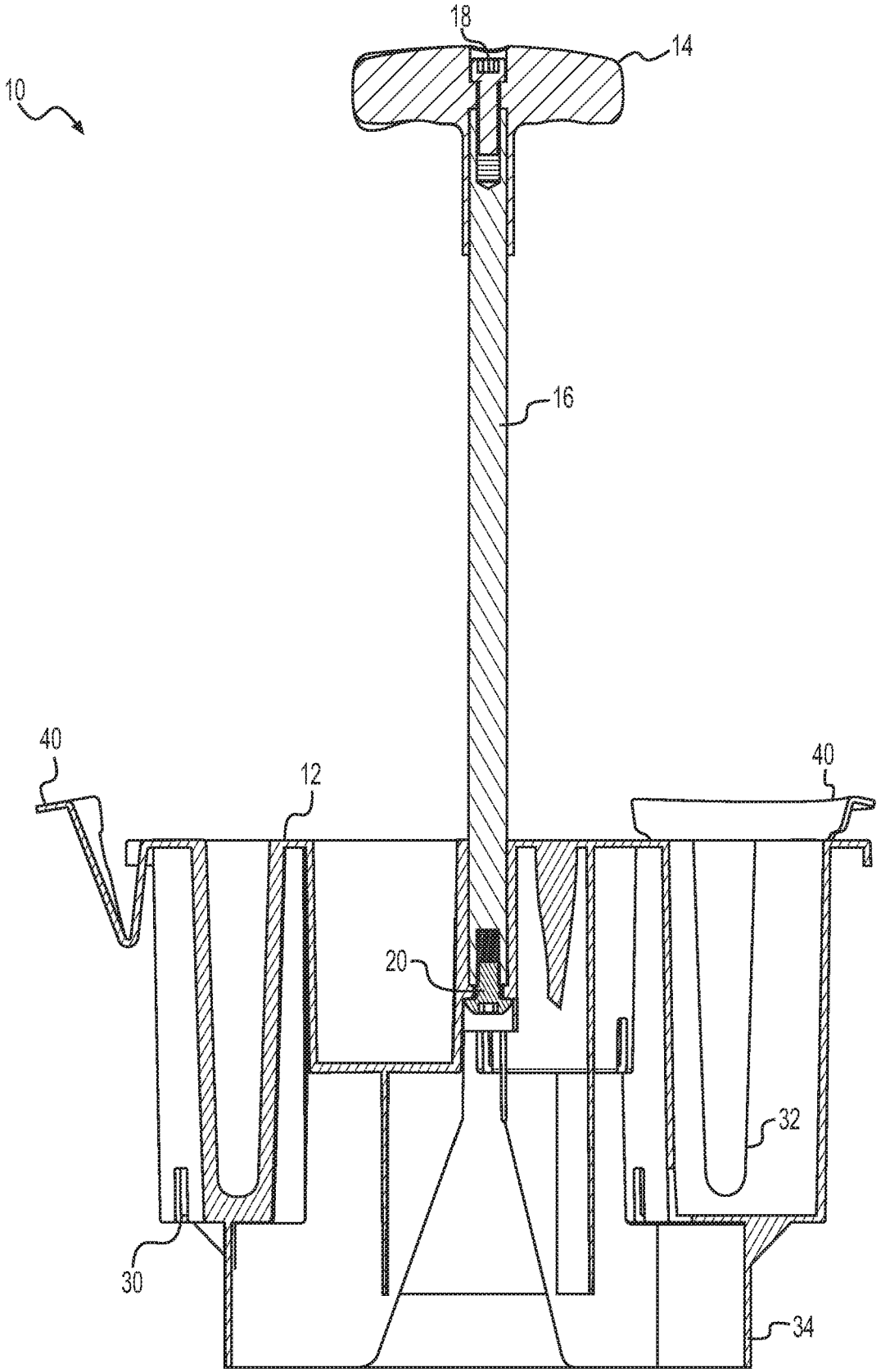
FIG. 6 is a sectional side view of the caulk caddy of FIG. 1.

As seen especially in FIG. 5, the main body 12 has a lower support structure 34 which in the illustrated embodiment is a circular downward protrusion from the floors 12 of the chambers 24. The lower support structure 34 provides additional structural strength and rigidity to the main body, as well as providing height to elevate the floors 12 to the desired level when the caddy 10 is inserted fully into a bucket (described further below). In this regard, the height of the lower support structure 34 may vary. The overall design of the lower support structure 34 may vary considerably. In the illustrated embodiment, support ribs or braces 36 span from the lower support structure 34 to the floors 12 to provide additional structural strength and rigidity.

The caddy 10 comprises a handle projecting upward from the main body. In the illustrated embodiment, the handle comprises a T-grip 14 affixed to the upper end of an elongated shaft 16 via a bolt 18. The lower end of the shaft 16 is attached to the main body 12 via a bolt 20. Any suitable handle structure may be used, or a handle may be omitted entirely. Any suitable mechanism may be used to attach the handle to the main body. The handle may be fixed length or expandable/retractable (e.g., telescoping). The handle may be readily detachable by a user. The elongated shaft of the handle may be constructed of any suitable material, such as any suitable metal, and the T-grip may be constructed of any suitable material, such as any suitably strong and durable plastic.

Figure 7:
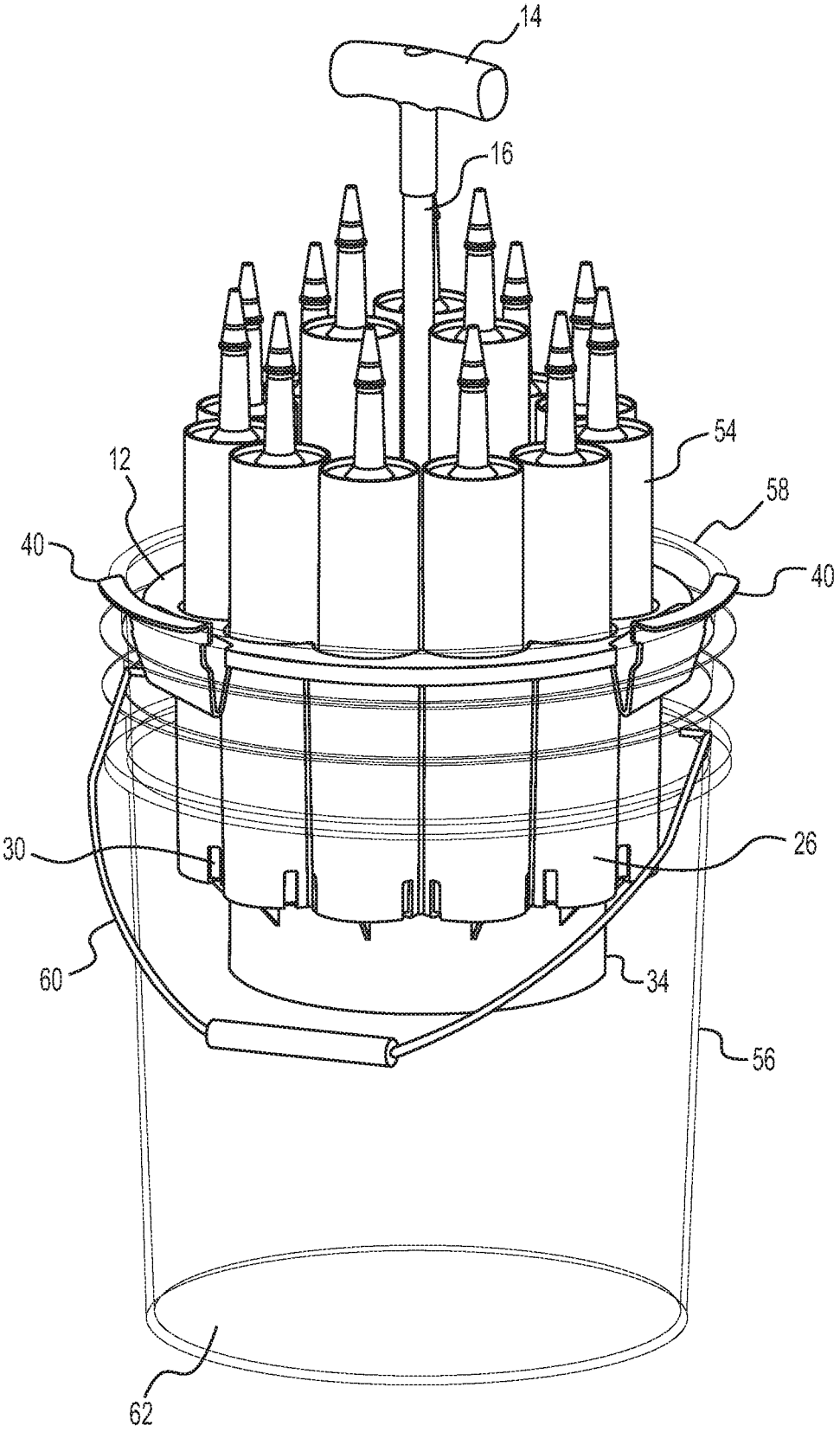
FIG. 7 is a perspective view of the caulk caddy of FIG. 1, positioned on the top edge of a standard five gallon bucket to access to the tubes of caulk.
Figure 8:
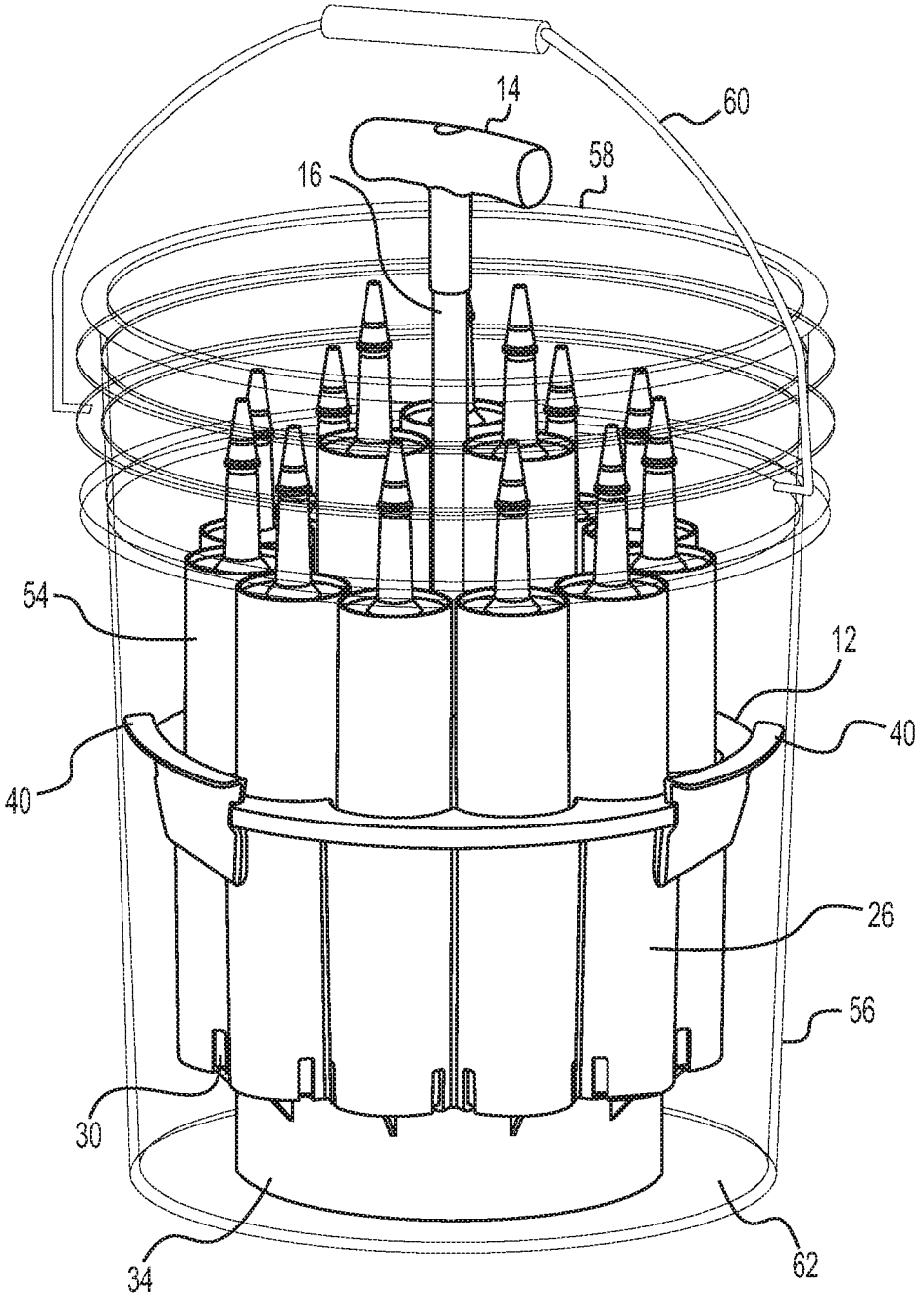
FIG. 8 is a perspective view of the caulk caddy of FIG. 1, positioned down in a standard five gallon bucket for carrying and storage.

The caddy of embodiments of the invention is sized and shaped to be readily inserted into and removed from a predetermined sized and shaped container. In one specific embodiment of the invention, the caddy is sized and shaped to be readily inserted into and removed from a standard five gallon bucket, such as the Letica Standard 5 Gallon Bucket from United States Plastic Corp. or the Homer Bucket from The Home Depot. Such a bucket is illustrated in FIGS. 7 and 8. The bucket 56 has a floor 62, a top rim 58, and a handle 60.

In one exemplary embodiment of the invention, the main body is about 7.25 inches tall from the bottom of the lower support structure to the top of the top deck, the top deck has a diameter of about 10.5 inches not including the tabs or about 11.9 inches including the tabs, and the handle has a height of about 10.75 inches from the top of the top deck to the top of the T-grip. The nominal wall thickness is roughly 0.10 inches. However, the caulk caddy of embodiments of the invention may have any suitable dimensions.

The caddy 10 of embodiments of the invention has a plurality of resilient tabs 40 attached to or integral with the main body 12 and spaced about a perimeter of the main body 12. In the illustrated embodiment there are three tabs 40 evenly spaced about the outer edge of the top deck 22. Fewer or more tabs may be used, although at least two are required and more than three may be unnecessary. The tabs 40 support the caddy 10 on the top rim 58 of the bucket 56 such that the main body 12 is elevated off the floor 62 of the bucket 56, as shown in FIG. 7. In this elevated position, a user is able to readily see the tubes 54 and select the desired tube. When the caddy 10 is in the position shown in FIG. 7 and a user applies a downward force to the main body 12 (such as by pushing down on the T-grip 14), the tabs 40 flex inward such that the main body 12 and the tabs 40 move downward into the bucket 56 until the main body 12 contacts the floor 62 of the bucket 56, as seen in FIG. 8. In this lowered position, a user is able to raise the handle 60 of the bucket 56 to carry the bucket 56 and the caddy 10 and tubes 54 contained therein. If the handle of the caddy is retractable or removable, it may be possible to place a lid on the bucket when the caddy is in the lowered position. When the caddy 10 is in the position shown in FIG. 8 and a user applies an upward force to the main body 12 (such as by pulling up on the T-grip 14), the main body 12 and the tabs 40 move upward until the tabs 40 are above the top rim 58 of the bucket 56 and spring outward such that the caddy 10 may again be supported on the top rim 58 of the bucket 56 as shown in FIG. 7.

In the illustrated embodiment, each tab 40 comprises a first section 42 that projects downward and outward from the main body 12, a second section 44 that projects upward and outward from the first section 42, and a third section 46 that projects outward from the second section 44. It is the third section 46 of each tab 40 that sits on the top rim 58 of the bucket 56 to support the main body 12. Notches 48 in the opposing side edges of the second section 44 are aligned with corresponding edges 50 of the top deck 22 to enable the second section 44 to flex inward toward the main body 12 without being obstructed by the top deck 22. The V-shape of the first and section sections 42, 44 provides the resiliency and outward bias that enables the tabs 40 to flex inward when the main body 12 is pushed down into the bucket and return to their original outward positions when freed from the bucket.

The specific material of construction of the tabs and/or the thickness of the sections of the tabs may be varied as needed to provide the desired amount of resiliency of the tabs. In one exemplary embodiment of the invention, the tabs are constructed of the same plastic as the main body. The outermost portion of each tab may be slightly thinner (about 0.08 inches thick) than the remainder of each tab and the walls of the main body to increase flexibility of the tabs.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A device for receiving and holding a plurality of objects, the device comprising:

a main body having a plurality of chambers defined therein, each chamber having an open top end, each chamber adapted to receive at least one object via its open top end; and a plurality of resilient tabs attached to or integral with the main body and spaced about a perimeter of the main body, each tab adapted to support the device on a top rim of a bucket such that the main body is elevated off a floor of the bucket, each tab adapted to flex inward toward a longitudinal axis of the main body when a downward force is applied to the main body such that the main body and the tabs move downward into the bucket until the main body contacts the floor of the bucket.

2. The device of claim 1, further comprising a handle projecting upward from the main body.

3. The device of claim 1, wherein the chambers are substantially vertical.

4. The device of claim 1, wherein the chambers are substantially cylindrical.

5. The device of claim 1, wherein at least one drainage hole is defined in a side wall or a floor of each chamber.

6. The device of claim 1, wherein the plurality of tabs comprises three tabs.

7. The device of claim 1, wherein the tabs are evenly spaced about the perimeter of the main body.

8. The device of claim 1, wherein each tab comprises a first section that projects downward and outward from the main body, a second section that projects upward and outward from the first section, and a third section that projects outward from the second section;

wherein the third section of each tab is adapted to sit on the top rim of the bucket to support the main body.

9. A method of storing and carrying a plurality of objects, the method comprising:

inserting each of the plurality of objects into a corresponding chamber of a device having a main body in which a plurality of chambers are defined and a plurality of resilient tabs attached to or integral with the main body and spaced about a perimeter of the main body, wherein each chamber has an open top end, wherein each tab is adapted to support the device on a top rim of a bucket such that the main body is elevated off a floor of the bucket, wherein each tab is adapted to flex inward toward a longitudinal axis of the main body when a downward force is applied to the main body such that the main body and the tabs move downward into the bucket until the main body contacts the floor of the bucket;

placing the device into the bucket such that the device is supported on the top rim of the bucket and such that the main body is elevated off a floor of the bucket; and applying a downward force to the main body such that the main body and the tabs move downward into the bucket until the main body contacts the floor of the bucket.

10. The method of claim 9, further comprising applying an upward force to the main body such that the main body and the tabs move upward until the tabs are above the top rim of the bucket and spring outward such that the device is supported on the top rim of the bucket and such that the main body is elevated off a floor of the bucket.

11. The method of claim 9, wherein the device further comprises a handle projecting upward from the main body.

12. The method of claim 9, wherein the chambers are substantially vertical.

13. The method of claim 9, wherein the chambers are substantially cylindrical.

14. The method of claim 9, wherein at least one drainage hole is defined in a side wall or a floor of each chamber.

15. The method of claim 9, wherein the plurality of tabs comprises three tabs.

16. The method of claim 9, wherein the tabs are evenly spaced about the perimeter of the main body.

17. The method of claim 9, wherein each tab comprises a first section that projects downward and outward from the main body, a second section that projects upward and outward from the first section, and a third section that projects outward from the second section;

wherein the third section of each tab is adapted to sit on the top rim of the bucket to support the main body.

18. A system for receiving and holding a plurality of objects, the system comprising:

a bucket having a top rim, a floor, and a wall therebetween;

a main body having a plurality of chambers defined therein, each chamber having an open top end, each chamber adapted to receive at least one object via its open top end; and a plurality of resilient tabs attached to or integral with the main body and spaced about a perimeter of the main body, each tab adapted to support the device on the top rim of the bucket such that the main body is elevated off the floor of the bucket, each tab adapted to flex inward toward a longitudinal axis of the main body when a downward force is applied to the main body such that the main body and the tabs move downward into the bucket until the main body contacts the floor of the bucket.

19. The system of claim 18, further comprising a handle projecting upward from the main body.

20. The system of claim 18, wherein the chambers are substantially vertical.

21. The system of claim 18, wherein the chambers are substantially cylindrical.

22. The system of claim 18, wherein at least one drainage hole is defined in a side wall or a floor of each chamber.

23. The system of claim 18, wherein the plurality of tabs comprises three tabs.

24. The system of claim 18, wherein the tabs are evenly spaced about the perimeter of the main body.

25. The system of claim 18, wherein each tab comprises a first section that projects downward and outward from the main body, a second section that projects upward and outward from the first section, and a third section that projects outward from the second section;

wherein the third section of each tab is adapted to sit on the top rim of the bucket to support the main body.

* * * * *